US008390205B2

(12) United States Patent
Li et al.

(10) Patent No.: US 8,390,205 B2
(45) Date of Patent: Mar. 5, 2013

(54) LED CONTROL USING MODULATION FREQUENCY DETECTION TECHNIQUES

(75) Inventors: Ming Li, Acton, MA (US); Kerry Denvir, Cambridge, MA (US); Philip E. Moskowitz, Georgetown, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 236 days.

(21) Appl. No.: 13/077,669

(22) Filed: Mar. 31, 2011

(65) Prior Publication Data

US 2012/0049745 A1 Mar. 1, 2012

Related U.S. Application Data

(63) Continuation-in-part of application No. 12/874,201, filed on Sep. 1, 2010, now Pat. No. 8,258,709.

(51) Int. Cl.
*H05B 37/02* (2006.01)

(52) U.S. Cl. ..... 315/153; 315/152; 315/308

(58) Field of Classification Search ..... 315/149, 315/152, 153, 246, 287, 291, 299, 307, 308
See application file for complete search history.

(56) References Cited

U.S. PATENT DOCUMENTS

| | | | | |
|---|---|---|---|---|
| 6,153,985 | A | 11/2000 | Grossman | |
| 7,557,518 | B2 | 7/2009 | Zagar et al. | |
| 7,671,542 | B2 | 3/2010 | Chang et al. | |
| 7,675,245 | B2 * | 3/2010 | Szczeszynski et al. | 315/291 |
| 7,800,315 | B2 | 9/2010 | Shteynberg et al. | |
| 7,919,936 | B2 * | 4/2011 | Liu et al. | 315/307 |
| 7,956,554 | B2 | 6/2011 | Shteynberg et al. | |
| 7,999,487 | B2 * | 8/2011 | Szczeszynski | 315/291 |
| 8,018,170 | B2 * | 9/2011 | Chen et al. | 315/192 |
| 8,035,314 | B2 * | 10/2011 | Zhao | 315/297 |
| 8,049,939 | B2 * | 11/2011 | Wilms et al. | 358/504 |
| 8,106,604 | B2 * | 1/2012 | Zhao et al. | 315/299 |
| 8,115,414 | B2 * | 2/2012 | Zhao et al. | 315/299 |
| 8,159,150 | B2 | 4/2012 | Ashdown et al. | |

(Continued)

FOREIGN PATENT DOCUMENTS

| | | | |
|---|---|---|---|
| EP | 1 635 617 | A2 | 3/2006 |
| WO | 2004/057922 | A1 | 7/2004 |

(Continued)

OTHER PUBLICATIONS

LM3409 / LM3409HV LM3409Q / LM3409QHV PFET Buck Controller for High Power LED Drivers, Literature Number: SNVS602H, Apr. 12, 2010, pp. 1-32, National Semiconductor/Texas Instruments, Santa Clara, California/Dallas, Texas.

(Continued)

*Primary Examiner* — Vibol Tan
(74) *Attorney, Agent, or Firm* — Shaun P. Montana

(57) ABSTRACT

A light emitting diode (LED) controller for controlling a plurality of LED channels includes channel select circuitry, detection circuitry, and error processor circuitry. The channel select circuitry is configured to drive N−1 LED channels of a plurality of (N) LED channels at a nominal modulation frequency and to selectively drive a selected one of the N LED channels at a probe modulation frequency. The detection circuitry is configured to receive a composite brightness signal corresponding to brightness signals from the N LED channels. The detection circuitry is further configured to filter the composite bright signal and generate a selected brightness signal corresponding to a brightness of the selected LED channel at the probe modulation frequency. The error processor circuitry is configured to compare the selected brightness signal to user defined and/or preset photometric quantities and generate a control signal for adjusting the brightness of the selected LED channel.

20 Claims, 7 Drawing Sheets

U.S. PATENT DOCUMENTS

| | | | | |
|---|---|---|---|---|
| 8,169,161 | B2 * | 5/2012 | Szczeszynski et al. | 315/308 |
| 8,179,051 | B2 * | 5/2012 | Zhao | 315/185 R |
| 8,258,709 | B2 * | 9/2012 | Moskowitz | 315/152 |
| 8,274,238 | B2 * | 9/2012 | Szczeszynski et al. | 315/247 |
| 8,279,144 | B2 * | 10/2012 | Zhao et al. | 345/82 |
| 2007/0052375 | A1 | 3/2007 | Lin et al. | |
| 2007/0115662 | A1 | 5/2007 | Roberts et al. | |
| 2008/0309255 | A1 | 12/2008 | Myers et al. | |
| 2009/0251067 | A1 | 10/2009 | Johnson | |

FOREIGN PATENT DOCUMENTS

| | | | |
|---|---|---|---|
| WO | 2004/057923 | A1 | 7/2004 |
| WO | 2006/054230 | A1 | 5/2006 |
| WO | 2007/121574 | A1 | 11/2007 |
| WO | 2009/019655 | A2 | 2/2009 |

OTHER PUBLICATIONS

David Morris, International Search Report and Written Opinion of the International Searching Authority, Dec. 27, 2011, pp. 1-16, European Patent Office, Rijswijk, The Netherlands.

Jon Martis, Closed Loop Chromaticity Control: Interfacing a Digital RGB Color Sensor to a PIC24 MCU, Microchip AN1257, DS01257A, Microchip Technology Inc., 2009.

Xiaohui Qu et al., Color Control System for RGB LED Light Sources Using Junction Temperature Measurement, The 33rd Annual Conference of the IEEE Industrial Electronics Society (IECON), Nov. 5-8, 2007, Taipei, Taiwan.

LED facts and Kelvin Color Temperature Charts, http://autolumination.com/colors.htm.

* cited by examiner

LED CONTROL USING MODULATION FREQUENCY DETECTION TECHNIQUES

CROSS-REFERENCE TO RELATED APPLICATION

The present application is a continuation-in-part of U.S. patent application Ser. No. 12/874,201, filed Sep. 1, 2010, the entire contents of which are hereby incorporated by reference.

TECHNICAL FIELD

The present application relates to LED control using modulation frequency detection techniques, and more particularly, to LED brightness and/or color control based on unique modulation frequencies used to drive independent LED strings.

BACKGROUND

LED control, in general, cannot be accomplished solely through the precise control of LED manufacturing variables, since the operating environment of the LED (temperature, current stability, infiltration of other light sources, etc.) may affect the color and intensity of the LED device. Known feedback control systems are used to control color and intensity of LEDs. One such known system involves the use of multichannel light sensors tuned to each color in the system. For example, a typical RGB system includes a string of red LEDs, a string of green LEDs and a string of blue LEDs. A multichannel RGB light sensor is placed in proximity to the light source in a location that is optimized to receive light flux from all three emitters. The sensor outputs signals indicative of the average total flux and the color point of the RGB system. A feedback controller compares this information to a set of preset or user-defined values. The multichannel sensor adds complexity and cost to the system design and architecture, and, in most cases, suffers from a lack of 1:1 correspondence between the light sensor and LED channels, making the color point calculations complex and limiting their accuracy.

Another known feedback control system utilizes a broadband sensor to sense the light from the LED channels. To control each individual channel, all other channels must be turned off so that the sensor can "focus" on a single color at a time.

BRIEF DESCRIPTION OF THE DRAWINGS

Reference should be made to the following detailed description which should be read in conjunction with the following figures, wherein like numerals represent like parts.

DETAILED DESCRIPTION

Generally, this application provides systems (and methods) for controlling the brightness of LEDs to compensate for uncontrolled changes in brightness and/or color. Temperature drift, aging of the LED devices, changes in the drive current, etc., can all cause changes in brightness, even if the duty cycle of the drive current to the LEDs remains fixed. To compensate for uncontrolled changes in brightness in one or more LED channels, one exemplary system drives each LED channel with a unique modulation frequency. Feedback control is provided that may utilize a single photodetector to sense the composite light from all the LED channels in the system, determine the amplitude of the light intensity at each unique modulation frequency, and compare that amplitude to preset and/or user programmable values to generate error signals. Each error signal, in turn, may used to control the duty cycle in each channel to compensate for any detected changes in brightness. In some embodiments, all of the LED channels may be controlled simultaneously and continuously.

Figure 1:
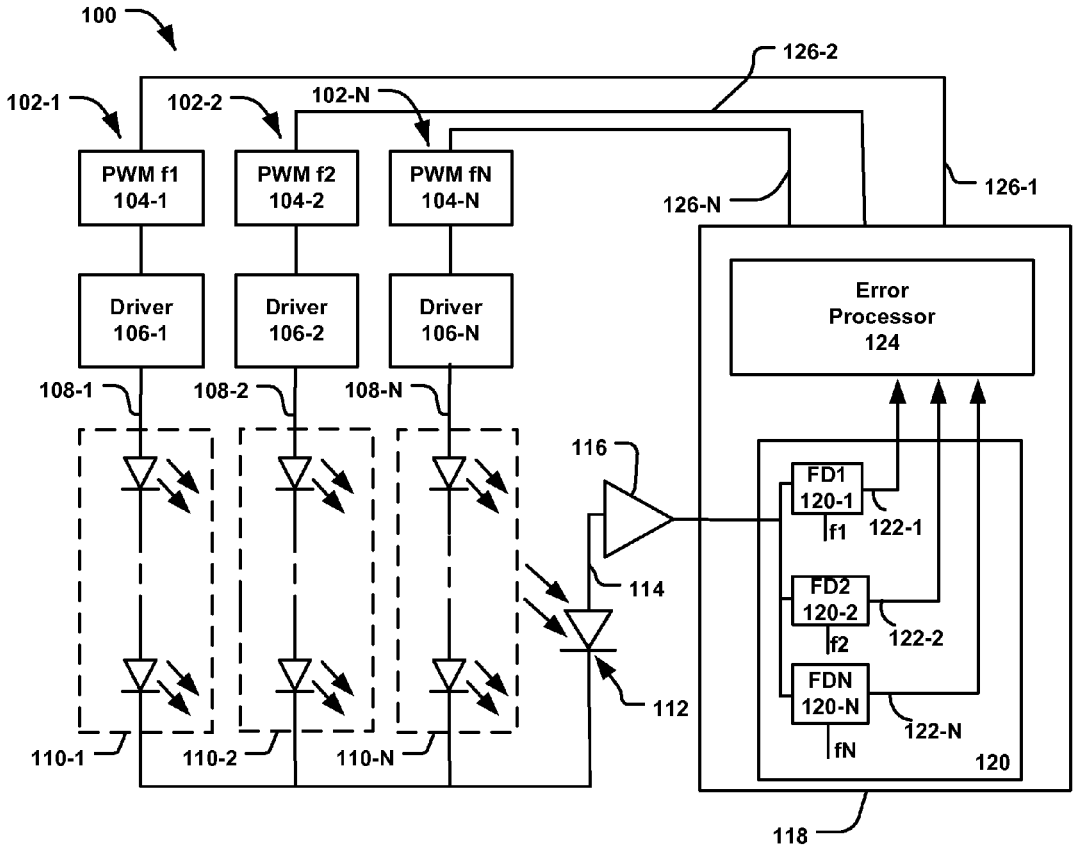
FIG. 1 is a diagram of one exemplary embodiment of a system consistent with the present disclosure.

FIG. 1 is a diagram of one exemplary embodiment of a system 100 consistent with the present disclosure. In general, the system 100 includes a plurality of light emitting diode (LED) channels 102-1, 102-2, . . . , 102-N, a photodetector 112 and an LED controller 118. Each respective LED channel may include pulse width modulation (PWM) circuitry 104-1, 104-2, . . . , 104-N, drive circuitry 106-1, 106-2, . . . , 106-N, and an LED string 110-1, 110-2, . . . , 110-N. Respective PWM circuitry 104-1, 104-2, . . . , 104N may be configured to generate respective PWM signals, each having a unique modulation frequency f1, f2, . . . , fN and to set the duty cycle of the respective PWM signals, based on feedback information as will be described in greater detail below. Each modulation frequency f1, f2, . . . , fN may be selected to be large enough to reduce or eliminate perceptible flicker, for example, on the order of several hundred to tens of thousands of Hz (for example, but not limited to, over 100 kHz). Also, to reduce or eliminate perceptible "beat" effects caused by having the on/off time of one channel too near the on/off time of another channel, each modulation frequency may be selected so that it is not within several hundreds of Hertz of other modulation frequencies.

Figure 2A:
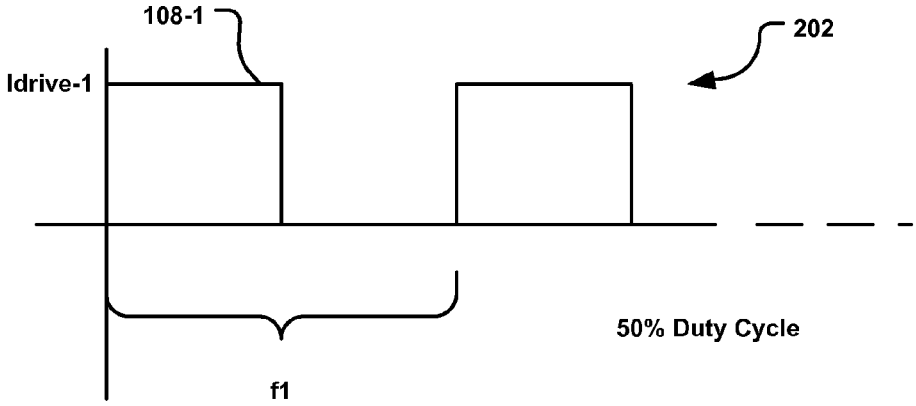
FIG. 2A is a signal diagram of a modulated current signal consistent with the present disclosure.

Driver circuitry 106-1, 106-2, . . . , 106-N may be configured to supply current to each respective LED string 110-1, 110-2, . . . , 110-N. Driver circuitry may include known DC/DC converter circuit topologies, for example, boost, buck, buck-boost, SEPIC, flyback and/or other known or after-developed DC/DC converter circuits. Of course, driver circuitry may also include AC/DC inverter circuitry if, for example, the front end of the drive circuitry is coupled to an AC power source. The current supplied by each driver circuitry may be the same, or different depending on, for example, the current requirements of each respective LED string. Typically, driver circuitry 106-1, 106-2, . . . , 106-N is configured to generate a maximum drive current, Idrive, that can power the LED string at full intensity. In operation, drive circuitry 106-1, 106-2, . . . , 106-N is configured to power a respective LED string 110-1, 110-2, . . . , 110-N with a respective modulated current 108-1, 108-2, . . . , 108-N that is modulated by a respective PWM signal modulated at a respective modulation frequency f1, f2, . . . , fN, having a respective duty cycle set by respective PWM circuitry 104-1, 104-2, . . . , 104N. Referring briefly to FIG. 2A, an example of modulated drive current 108-1 in the first channel 102-1 is depicted. The modulated current signal 202 in this example is modulated at a frequency of f1. Assuming a 50% duty cycle, the current Idrive is delivered to LED string 110-1 during the ON time of the first half of a period of f1, and no current is delivered to LED string 110-1 during the OFF time of the second half of a period of f1. To control the overall brightness in each LED string, the duty cycle of each respective PWM signal may be adjusted. For example, the duty cycle in each channel may independently range from 0% (fully off) to 100% (fully on) to control the overall brightness (luminosity) and of each respective string. Color and/or brightness control, as described herein, may be accomplished by controlling the brightness of each LED string independently of the other strings, and the color of any given LED string may be proportional to the brightness of that LED string.

Referring again to FIG. 1, each LED string 110-1, 110-2, . . . , 110-N may include one or more individual LED devices. Each string may be arranged by color, for example a red, green, blue (RGB) topology in which string 110-1 may include one or more LEDs that emit red light, string 110-2 may include one or more LEDs that emit green light and string 110-N may include one or more LEDs that emit green light. Of course, this is only an example and other color arrangements are equally contemplated herein, for example, RGW (red, green, white), RGBY (red, green, blue, yellow), infrared, etc., without departing from this embodiment. While the system of FIG. 1 depicts multiple LED strings 110-1, 110-2, . . . , 110-N, this embodiment may instead include a single LED string. Since the power to each LED in each respective LED string may be modulated by each respective modulation frequency f1, f2, . . . , fN, the brightness signal emitted by each LED string may have similar features as the PWM signal that modulates its power.

Figure 2B:
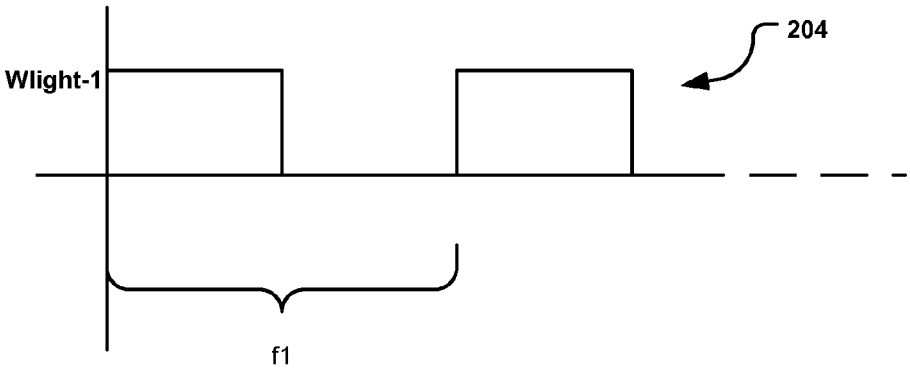
FIG. 2B is a signal diagram of a pulse width modulated (PWM) brightness signal consistent with the present disclosure.

Photodetector circuitry 112 may be configured to detect superimposed PWM brightness signals from the LED strings and generate an LED brightness signal 114 (e.g., current signal) proportional to the superimposed PWM brightness signals. To enable simultaneous control of all the LED strings in the system, photodetector 112 may be configured to detect the combined, superimposed PWM brightness signals of all the LED sources. An example of a PWM brightness signal for channel 102-1 is depicted in FIG. 2B. Again assuming a 50% duty cycle of the PWM signal, the brightness signal 204 is modulated with a frequency f1, and may swing from an amplitude of Wlight−1 to zero, according to the duty cycle in channel 102-1. In this example, Wlight−1 may be proportional to the average flux emitted by LED string 110-1. The PWM brightness signals of each of the other LED strings in the system 100 may have features similar to those depicted in FIG. 2B, and the overall brightness signal of the LEDs in the system 100 is a superposition of each individual brightness signal, each with its own unique modulation frequency (and, generally, its own unique duty cycle). The superimposed PWM brightness signals may therefore include a first PWM brightness signal having an amplitude proportional to the brightness of LED string 110-1 and having a frequency and duty cycle corresponding to channel 102-1, a second PWM brightness signal having an amplitude proportional to the brightness of LED string 110-2 and having a frequency and duty cycle corresponding to channel 102-2, and up to an nth PWM brightness signal having an amplitude proportional to the brightness of LED string 110-N and having a frequency and duty cycle corresponding to channel 102-N. It may be understood that the change in amplitude of the brightness signal may be proportional to the uncontrolled changes in LED brightness. Back to FIG. 1, the photodetector circuitry 112 may be a broadband light detection device configured with an optical response spanning the full color spectrum of all the LEDs in the system and configured with a relatively "flat" electrical frequency response across the range of modulation frequencies f1, f2, . . . , fN. Photodetector circuitry 112 may be positioned in close proximity to the LED strings to enable the detector 112 to receive and detect light from the LED strings, and to reduce or eliminate interference from external light sources. Optically translucent diffusers such as those commonly used in LED light sources may also be used to reduce or eliminate interference from external light sources. Known broadband photodetectors that may be used in accordance with this disclosure include, for example, the OSRAM Opto Semiconductors phototransistor SFH3710, the Vishay photodiode TEMT6200FX01 and the Vishay photodiode TEMD6200FX01. The output 114 of photodetector circuitry 112 may include a composite brightness signal represented as an include electrical signals proportional to the superimposed PWM brightness signals from the LED sources in the system.

LED controller circuitry 118 may include frequency and amplitude detection circuitry 120 and error processor circuitry 124. As an overview, controller circuitry 118 may be configured to receive the LED brightness signal 114 (as may be amplified by amplifier 116), and detect the product of the amplitude and duty cycle, hereinafter referred to as the "pulse area", of each respective PWM brightness signal superimposed within the LED brightness signal at each respective unique modulating frequency. Controller circuitry 118 may also generate signals proportional to the pulse area ("pulse area signals") and compare the pulse area signals to user defined and/or preset brightness values to generate error signals proportional to the difference between the detected brightness and the user defined and/or preset brightness values. Frequency and amplitude detection circuitry 118 may include a plurality of physical and/or logical detector circuits 120-1, 120-2, . . . , 120-N. Each respective detector circuit 120-1, 120-2, . . . , 120-N may be configured to filter the signal 114 at each respective modulation frequency f1, f2, . . . fN and detect the amplitude of each respective signal at the respective modulation frequency. Thus, as an example, circuit 120-1 may be configured to filter the incoming LED brightness signal 114 (which is the composite signal of superimposed PWM brightness signals) to filter out all of the signals except the PWM brightness signal having a frequency of f1 (being emitted by the LED string 110-1). Once the appropriate PWM brightness signal is isolated from the collection of signals in signal 114, circuit 120-1 may be configured to detect the pulse area of the PWM brightness signal at frequency f1. Each of circuits 120-2-120N may be configured in a similar manner to filter and detect at their respective modulation frequencies, and to generate pulse area signals 122-2-122-N proportional to the respective pulse area of the PWM brightness signal.

Figure 3:
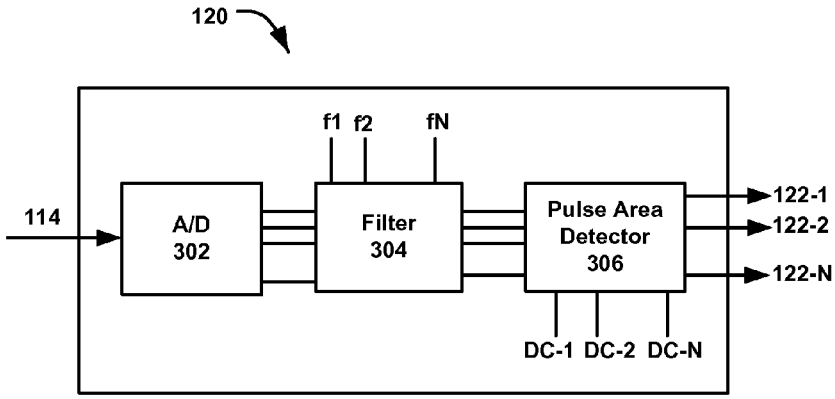
FIG. 3 is a block diagram of one exemplary embodiment of frequency and amplitude detection circuitry consistent with the present disclosure.

FIG. 3 is a block diagram of an exemplary embodiment of frequency and amplitude detection circuitry 120 consistent with the present disclosure. In this embodiment, circuitry 120 may include an A/D converter circuit 302 configured to digitize signal 114. The sampling rate and bit depth of circuit 302 may be selected on, for example, a desired resolution in the digital signal. To that end, the sampling rate may be selected to avoid aliasing, i.e., selected to be greater than or equal to twice the largest modulation frequency among f1, f2, . . . , fN. Circuitry 120 may also include a filter circuit 304. Filter circuit 304 may be configured to filter the signal to isolate each respective PWM brightness signal modulated at respective modulation frequencies f1, f2, . . . , fN. In addition, filter circuitry 304 may be configured to filter the incoming signal 114 to reduce or eliminate high frequency components in the signal 114 (e.g., low pass filtering techniques). Known filtering techniques may be used including, for example, Fourier Transform (FT), fast Fourier Transform (FFT), phase sensitive detection methods, etc.

Figure 2C:
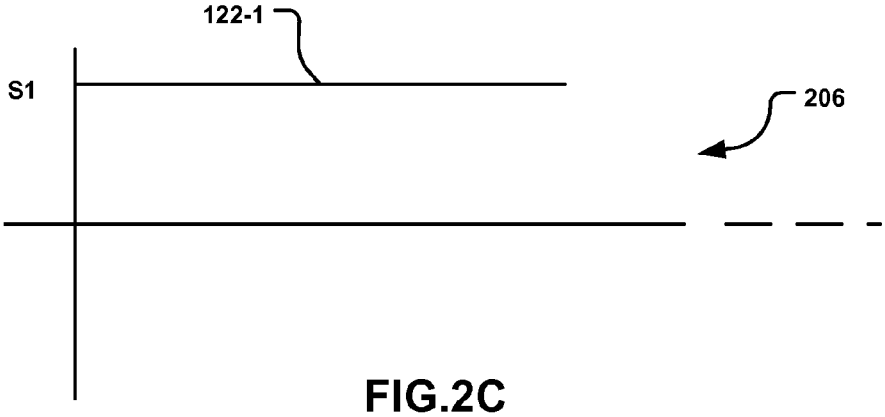
FIG. 2C is a signal diagram of a pulse area signal consistent with the present disclosure.

Circuitry 120 may also include pulse area detection circuitry 306. Pulse area detection circuitry 306 may be configured to detect a pulse area of each respective PWM brightness signal at each respective modulation frequency f1, f2, . . . , fN and for each respective duty cycle. The output of pulse area detection circuitry 306 may includes a plurality of pulse area signals 122-1, 122-2, . . . , 122-N that are proportional to the respective pulse area of each channel, i.e., proportional to the product of the amplitude and the duty cycle of each PWM brightness signal for each channel. FIG. 2C provides an example of an pulse area signal 206 for channel 102-1. In this example, signal 122-1 is generally a DC signal having an amplitude that is proportional to the pulse area of the PWM brightness signal for channel 102-1. In this example, the amplitude of signal 122-1 has a value S1, where S1 is a function of both the amplitude (flux) of the light emitted by LED string 110-1 and the duty cycle of channel 102-1. Of course, each pulse area signals from the other channel in the system may have similar features as those depicted in FIG. 2C. Changes in the pulse area signal (i.e., changes in the DC value S) may be proportional to uncontrolled changes in the brightness of subject LED string.

While the foregoing description of the frequency and amplitude detection circuitry 120 may utilize digital filtering and detection, in other embodiments the circuitry 120 may include hardwired circuitry to perform operations as described above. For example, filter circuits may be formed using known electronic components (transistors, resistors, capacitors, amplifiers, etc.) and each may be tuned to filter at a specific frequency, e.g., f1, f2, . . . , fN. Similarly, amplitude detection circuits and multiplier circuits may be formed using hardwired circuitry to perform operations as described above.

Figure 4:
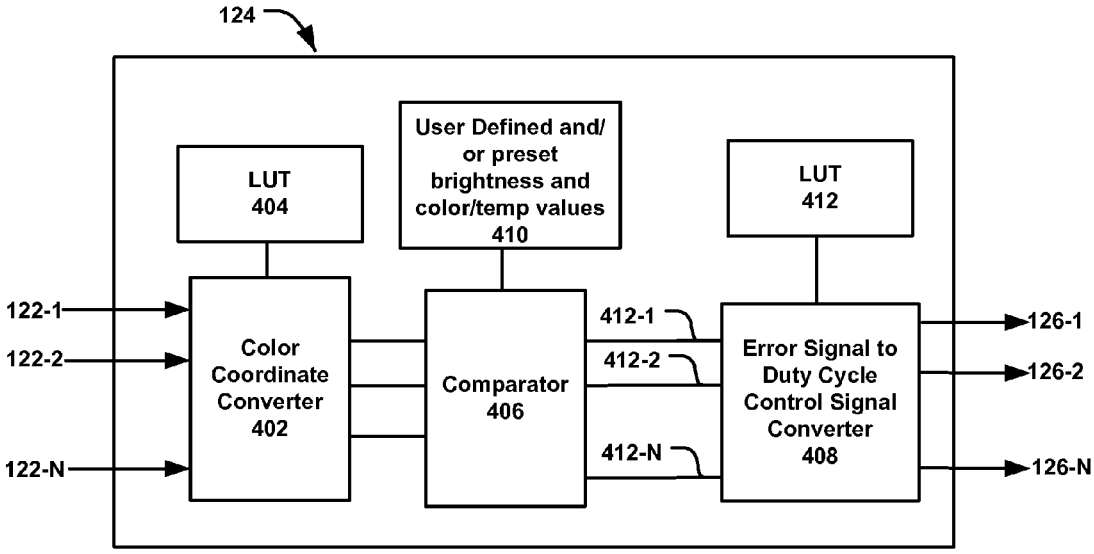
FIG. 4 is a block diagram of one exemplary embodiment of error processor circuitry consistent with the present disclosure.

FIG. 4 is a block diagram of an exemplary embodiment of a error processor circuitry 124 consistent with the present disclosure. In this embodiment, circuitry 124 may include color coordinate converter circuitry 402. Circuitry 402 may be configured to convert the set of pulse area signals 122-1, 122-2, . . . , 122-N into a set of N values that define the light source in terms of standard photometric quantities. For example: for N=3, the output of color coordinate converter 402 may be an x, y point in a chromaticity space and a single luminance value. Examples of known chromaticity space domains include xyz, uvw, Luv Lab, etc., however, other known or after-developed chromaticity space domains may be used. For example, circuitry 402 may comply or be compatible with a color space defined by the International Commission on Illumination (C.I.E) which defines an RGB color space into a luminance ("Y") parameter, and two color coordinates x and y which may correlate to points on a known chromaticity diagram. Using the (x,y,Y) space as an example, circuitry 402 may be configured to convert the signals 122-1, 122-2, . . . , 122-N, where N is greater than or equal to 3, into a single set of x, y, and Y coordinates and additional photometric quantities up to N total values. A look-up table 404 (LUT), created by calibrating the light source with a photometer or similar instrument (described below), may be an N×N matrix of numbers which correlates the signals 122-1, 122-2, . . . , 122-N to the coordinate space of choice. Thus, as a further example: for N=4, the output of circuitry 402 may be the vector (x,y,Y), and a single number representing the color rendering index (CRI) of the source, a well known photometric quantity.

Comparator circuitry 406 may be configured to compare the space coordinates from circuitry 402 to a user defined and/or programmed set of values 410. The values 410 may represent the target or desired overall brightness and/or color (temperature) of the LED strings. Continuing with the N=3 example given above, comparator 406 may be configured to compare the (x, y, Y) data point of the detected signal with the (x, y, Y) data point of the preset and/or user defined values 410. The output of comparator 406 may be a set of error signals 412-1, 412-2, 412-3 in the selected (x,y,Y) space. Thus, for example, error signal 412-1 may include a value representing the difference between the measured x chromaticity value of the source and the preset and/or user definable value 410. Similarly, error signals 412-2 and 412-3 may be generated for the y and Y coordinate.

While the error signals 412-1, 412-2, . . . 412-N may represent a difference between a target and actual set point for the light source, these signals may be converted back into a signal form usable by the PWM circuitry. To that end, error processor circuitry 124 may also include error signal to duty cycle control signal converter circuitry 408. Circuitry 408 may be configured to receive the error signals 412-1, 412-2, . . . 412-N in the selected space coordinates and convert those signals into respective control signals 126-1, 126-2, . . . , 126-N that are in a form that is usable by respective PWM circuitry 104-1, 104-2, . . . , 104-N. To that end, circuitry 124 may include a second LUT 412 that circuitry 408 may use to correlate the error signals in the selected chromaticity space to a DC value. In one embodiment, LUT 412 may include the same information as LUT 404 but represented in an inverse fashion to enable circuitry 408 to determine a DC value based on the inputs (i.e., LUT 412 may be the inverse of LUT 404. Thus, control signals 126-1, 126-2, . . . , 126-N may be DC signals having values based on the error detected by comparator circuitry 406. In operation, control signals 126-1, 126-2, . . . , 126-N may control respective PWM circuitry 104-1, 104-2, . . . , 104-N to adjust the respective duty cycle in proportion to a detected error in each photometric quantity. One example of error processor circuitry that may be utilized with the present application is the PIC24F MCU family of microprocessors manufactured by Microchip Technology Inc., and described in Microchip Application Note AN1257 published by Microchip Technology Inc.

The calibration of a light source with feedback properties as described herein is for the purpose of generating LUT 404 and the LUT 412 in FIG. 4. The LUT maps the N pulse area signals 122-1, 122-2, . . . 122-N of the light source to N standard photometric quantities. The N photometric quantities can include x, y chromaticity, Y luminance, CRI, correlated color temperature (CCT), etc. Calibration proceeds with selective activation of each color in the light source to the exclusion of all others. Each color may be activated at the 100% luminance level. An instrument, e.g., a Photometer, calibrated to measure the photometric properties of each LED string 1, 2, . . . N may be used, and yields N vectors each with N values ($s_1$, $s_2$, . . . $s_N$). The N vectors are then used to create an N×N matrix which defines the LUT. For example and for the case N=3, Microchip Application Note AN1257 published by Microchip Technology Inc. describes this type of calibration process in detail. Typically, calibration occurs when the LED strings are installed or one or more strings are changed.

Figure 5:
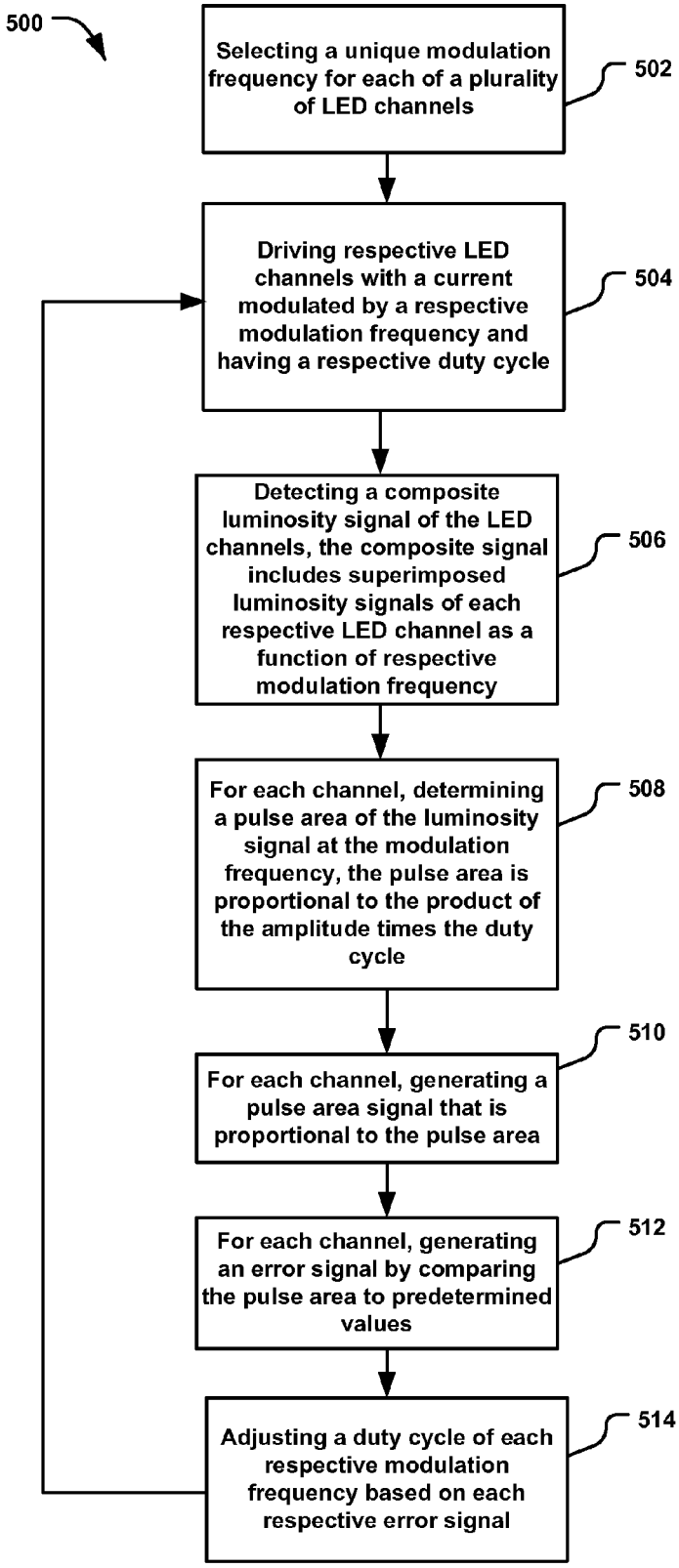
FIG. 5 is a block flow diagram of one exemplary method consistent with the present disclosure.

FIG. 5 is a block flow diagram 500 of one exemplary method consistent with the present disclosure. The method according to this embodiment may include selecting a unique modulation frequency for each of a plurality of LED channels 502. Each unique modulation frequency may be selected to reduce or eliminate flicker on each channel, and to reduce or eliminate beat effects between channels. Operation 504 may include driving respective LED channels with a current modulated by a respective unique modulation frequency. Each modulated current signal may have a respective duty cycle to deliver controllable current to the LED channel. Operations may also include detecting a composite luminosity signal of the LED channels, the composite signal includes superimposed luminosity signals of each LED channel as a function of respective modulation frequency 506. Thus, in one embodiment, the brightness signals of each LED channel may be detected simultaneously.

Operations according to the method of this embodiment may also include, for each channel, determining a pulse area of the luminosity signal at the modulation frequency 508. The pulse area is proportional to the product of the amplitude of the luminosity signal times the duty cycle of the luminosity signal. For each channel, the method may also include generating a pulse area signal that is proportional to the pulse area 510. Operations according to this embodiment may also include, for each channel, generating an error signal by comparing the pulse area signal to predetermined values 512. The predetermined values may be, for example, preset or user programmable values of brightness and/or color. The error signals may represent a difference between the pulse area signals and the predetermined values. Operations of this embodiment may also include adjusting a duty cycle of a respective modulation frequency based on a respective error signal 514. This operation may include controlling a PWM signal generator to control the duty cycle of the PWM signal based on the error signal. In this embodiment, the method may enable continuous and simultaneous feedback control of the LED channels by continuing operations at 504.

While FIG. 5 depicts exemplary operations according to one embodiment, it is to be understood that other embodiments of the present disclosure may include subcombinations of the operations depicted in FIG. 5 and/or additional operations described herein. Thus, claims presented herein may be directed to all or part of the components and/or operations depicted in one or more figures. In addition, there is no requirement that the operations depicted in FIG. 5, or described elsewhere herein, need to occur in the order presented, unless stated otherwise.

Figure 6:
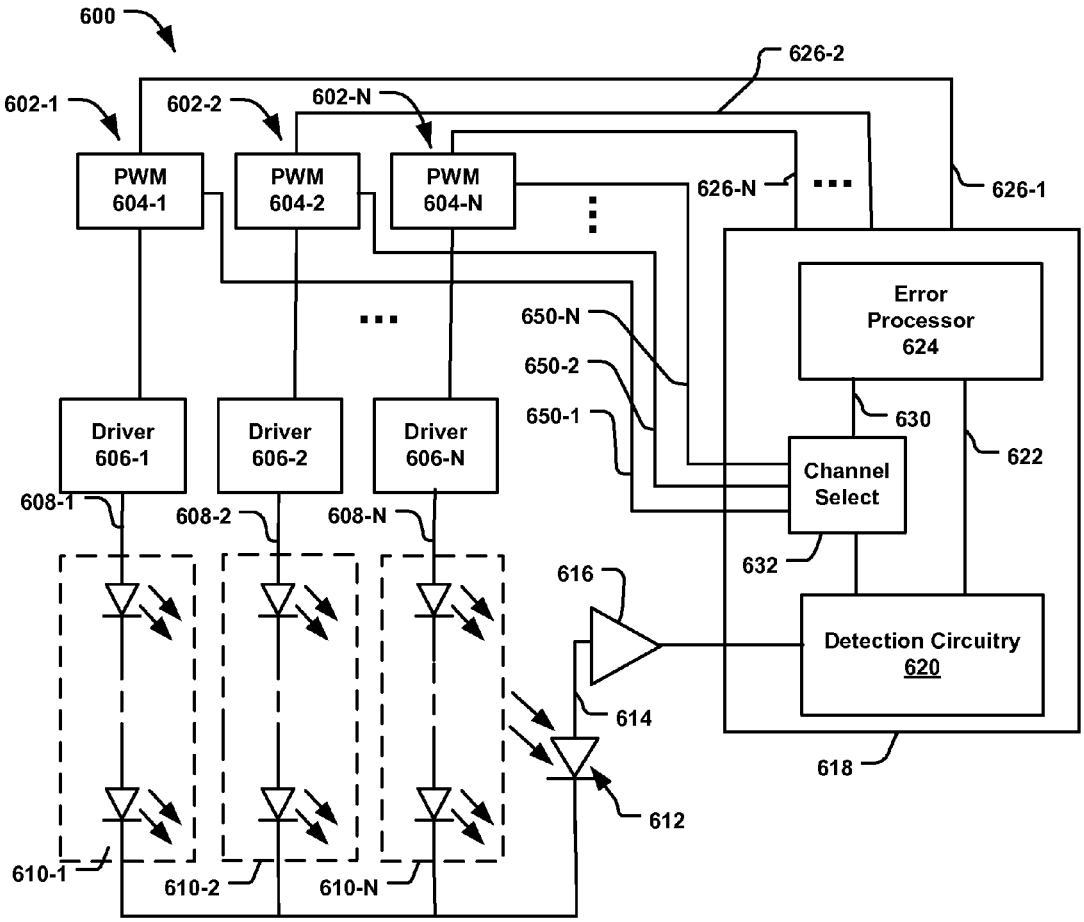
FIG. 6 is a diagram of another exemplary embodiment of a system consistent with the present disclosure.

In another embodiment, the present disclosure may feature a system and method (FIGS. 6-9) to detect light intensity for each of a plurality of LED strings using at least two modulation frequencies (e.g., one or more nominal modulation frequencies and a probe modulation frequency) and to compensate for uncontrolled changes in brightness. The system 600 of FIG. 6 includes a plurality of (N) LED channels 602-1, 602-2 . . . , 602-N, a photodetector 614, and a light emitting diode (LED) controller 618 configured to select and adjust the brightness of one of the LED channels.

By way of an overview, the LED controller 618 includes channel select circuitry 632, detection circuitry 620, and error processor circuitry 624. The channel select circuitry 632 is configured to drive N−1 LED channels of the N LED channels 602-1, 602-2 . . . , 602-N at a nominal modulation frequency $f_{nom}$ and to drive a selected one of the N LED channels 602-1, 602-2 . . . , 602-N at a probe modulation frequency $f_p$. Detection circuitry 620 is configured to receive a composite brightness signal 614 from a single photodetector 614 which corresponds to a plurality of brightness signals from the N LED channels 602-1, 602-2 . . . , 602-N. The detection circuitry 620 is further configured to filter the composite brightness signal 614 and generate a selected brightness signal 622 corresponding to a brightness of the selected LED channel at the probe modulation frequency $f_p$. Error processor circuitry 624 is configured to compare the selected brightness signal 622 to user defined and/or preset photometric quantities and generate a control signal 626-1, 626-2, . . . , 626N for adjusting the brightness of the selected LED channel 602. Each LED channel 602-1, 602-2 . . . , 602-N may be selected (e.g., sequentially) in order to generate a control signal for each LED channel 602-1, 602-2 . . . , 602-N. Advantageously, using two modulation frequencies (nominal and probe) may result in comparatively simpler circuitry and may further result in a reduced susceptibility to interference and/or beating between multiple frequencies.

According to one exemplary embodiment, each respective LED channel 602-1, 602-2, . . . , 602-N may include an LED string 610-1, 610-2, . . . , 610-N, driver circuitry 606-1, 606-2, . . . , 606-N, and modulation circuitry (e.g., pulse width modulation (PWM) circuitry) 604-1, 604-2, . . . , 604-N. LED strings 610-1, 610-2, . . . , 610-N may include one or more (e.g., a plurality) of LEDs. One or more of the LED strings 610-1, 610-2, . . . , 610-N may emit light at a different wavelength as described herein. Driver circuitry 606-1, 606-2, . . . , 606-N may be configured to supply current to each respective LED string 610-1, 610-2, . . . , 610-N. As discussed herein, the current provided to each respective LED string 610-1, 610-2, . . . , 610-N may be adjusted by a respective duty cycle provided to the driver circuitry 606-1, 606-2, . . . , 606-N and/or adjusting the amplitude of the current provided by the driver circuitry 606-1, 606-2, . . . , 606-N.

Each PWM circuitry 604-1, 604-2, . . . , 604N may be configured to generate respective PWM signals and (optionally) set the respective duty cycles of the respective PWM signals based on the control signals 626-1, 626-2, . . . , 626-N as described herein. The PWM signals generated by the PWM circuitry 604-1, 604-2, . . . , 604N have a modulation frequency which may includes either a nominal modulation frequency ($f_{nom}$) or a probe modulation frequency ($f_p$). The nominal modulation frequency $f_{nom}$ and probe modulation frequency $f_p$ may be selected to be large enough to reduce or eliminate perceptible flicker, for example, on the order of several hundred to tens of thousands of Hz (for example, but not limited to, over 100 kHz).

Photodetector circuitry 612 may be configured to generate a composite LED brightness signal 614 corresponding to a plurality of brightness signals from all of the LED channels 602-1, 602-2 . . . , 602-N. The composite LED brightness signal 614 may include a superimposed selected brightness signal (i.e., the brightness signal corresponding to the LED channel 602 modulated at $f_p$) and unselected brightness signals (i.e., the brightness signals corresponding to the N−1 LED channels 610 modulated at $f_{nom}$).

LED controller circuitry 618 may include detection circuitry 620, channel select circuitry 632, and an error processor 624. In particular, detection circuitry 620 is configured to receive the composite LED brightness signal 614 (as may be amplified by amplifier 616), filter out the contributions from the unselected LED strings (i.e., to pass the probe modulation frequency $f_p$ and to stop (attenuate) the nominal modulation frequency $f_{nom}$), and determine the product of the amplitude and duty cycle (hereinafter referred to as the "pulse area") corresponding to a selected brightness signal superimposed within the LED brightness signal as explained herein. It may be understood that the pulse area may include metrics such as, but not limited to, root mean square (RMS), such as frequency-selective RMS.

Channel select circuitry 632 is configured to select (for example, sequentially at predefined intervals) which one of the plurality of N LED strings 610-1, 610-2, . . . , 610-N will be modulated at the probe modulation frequency $f_p$ for determining an associated control signal 626 (which may be used to control the duty cycle of the selected LED channel and/or adjust the amplitude of the current provided by the driver circuitry 606-1, 606-2, . . . , 606-N). For example, channel select circuitry 632 may be configured to provide an output signal 650-1, 650-2, . . . , 650N with two possible states (e.g., high and low) to each of the PWM circuits 604-1, 604-2, . . . , 604N. In order to select a particular LED channel 602-1, 602-2, . . . , 602-N for probing, the channel select circuitry 632 may provide a high output signal 650 to each of N−1 unselected PWM channels 604 and a low output signal 650 to the selected PWM circuit 604.

Channel select circuitry 632 may select each PWM circuit 604-1, 604-1, . . . , 604-N in turn by controlling the value of the output signals 650-1, 650-2, . . . , 650-N. Of course, other techniques may be utilized for selecting a PWM circuit 604 for detecting brightness. Each PWM circuit 604-1, 604-1, . . . , 604-N may then be configured to adjust its associated modulation frequency in response to the channel select circuitry signal 650. PWM circuits 604 corresponding to unselected channels may be configured to provide an output at the nominal modulation frequency $f_{nom}$, and the PWM circuit 604 corresponding to the selected channel may be configured to provide an output at the probe modulation frequency $f_p$. Channel select circuitry 632 may also be configured to provide an identifier 630 corresponding to the selected LED channel 602-1, 602-2, . . . , 602-N to the error processor 624.

Error processor 624 may be configured to receive and to process the pulse areas from the detection circuitry 620 corresponding to the LED channels 602-1, 602-2, . . . , 602-N and generate control signals 626-1, 626-2, . . . , 626-N to adjust the brightness of the LED strings 610-1, 610-2, . . . , 610-N. Controller circuitry 618 may store an error signal for each of the plurality of LED channels 602-1, 602-2, . . . , 602-N as explained herein. The control signals 626-1, 626-2, . . . , 626-N may be used to control the duty cycle provided by the PWM circuits 604-1, 604-2, . . . , 604-N as described herein. Alternatively (or in addition), the control signals 626-1, 626-2, . . . , 626-N may be used to control the current generated by the driver circuits 606-1, 606-2, . . . , 606-N (e.g., the amplitude of the current). While the LED strings 610-1, 610-2, . . . , 610-N may be controlled simultaneously, each respective error signal may be determined sequentially and stored by, e.g., LED controller circuitry 618.

Figure 7A:
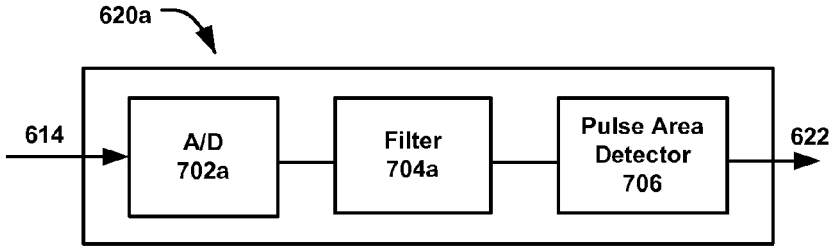
FIGS. 7A and 7B are block diagrams of exemplary embodiments of frequency and amplitude detection circuitry corresponding to the system of FIG. 6 consistent with the present disclosure.
Figure 7B:
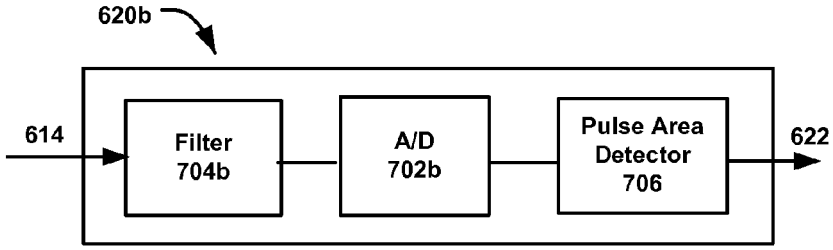

Turning now to FIGS. 7A and 7B, two exemplary embodiments of detection circuitry 620*a*, 620*b* for determining pulse area based on the composite LED brightness signal 614 (from the photodetector 612) are generally illustrated. In particular, detection circuitry 620*a*, FIG. 7A, includes analog to digital converter A/D 702*a* configured to digitize the received composite LED brightness signal 614. The digitized LED signal includes contributions from both the unselected LED strings (i.e., the LED 610 strings modulated at the nominal modulation frequency $f_{nom}$) and the selected LED string (i.e., the LED string 610 modulated at the probe modulation frequency $f_p$). Filter 704*a* is configured to filter out the contributions from the unselected LED strings 610. Stated another way, filter 704*a* is configured to allow the brightness signal corresponding to the LED strings 610 modulated at the probe modulation frequency $f_p$ to pass while stopping (attenuating) brightness signals corresponding to the LED strings 610 modulated at the nominal modulation frequency $f_{nom}$. Filter 704*a* may be a digital filter, as described herein. Filter 704*a* may be a low pass filter, a band pass filter, a band stop filter or a high pass filter. For example, if the probe frequency $f_p$ is greater than the nominal frequency $f_{nom}$, filter 704*a* may be a band pass or a high pass filter. The filtered and digitized LED signal that includes contribution from the selected LED channel may then be provided to the pulse area detector 706. The pulse area detector 706 is configured to determine the pulse area 622, as described herein. The modulation frequency of the filtered and digitized LED signal corresponds to the probe frequency $f_p$. The pulse area 622 may then be provided to the error processor circuitry 624.

Detection circuitry 620*b*, FIG. 7B, includes filter 704*b* is configured to filter the composite LED signal 614. Similar to filter 704*a*, filter 704*b* is configured to allow the brightness signal corresponding to the LED strings 610 modulated at the probe modulation frequency $f_p$ to pass while stopping (attenuating) brightness signals corresponding to the LED strings 610 modulated at the nominal modulation frequency $f_{nom}$. Filter 704*b* may be a low pass filter, a band pass filter, a band stop filter or a high pass filter. Filter 704*b* may be an analog filter and may include passive elements (e.g., one or more resistors, capacitors, and/or inductors) as well as active elements (e.g., one or more transistors and/or operational amplifiers). The filtered LED signal that includes contributions from the selected LED string 610 may then be digitized by analog to digital converter A/D 702*b*. The filtered and digitized LED signal may then be provided to the pulse area detector 706. The pulse area detector 706 is configured to determine the pulse area 622, as described herein. The modulation frequency of the filtered and digitized LED signal corresponds to the probe frequency $f_p$. The pulse area 622 may then be provided to the error processor circuitry 624.

Figure 8:
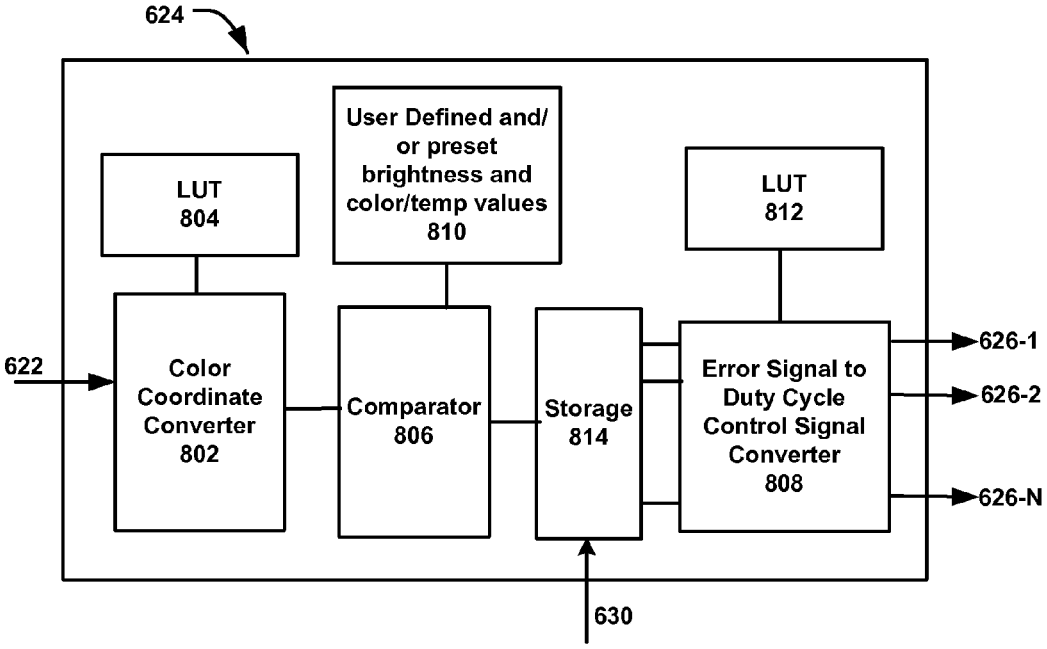
FIG. 8 is a block diagram of another exemplary embodiment of error processor circuitry corresponding to the system of FIG. 6 consistent with the present disclosure.

Turning now to FIG. 8, one exemplary embodiment of error processor circuitry 624 is generally illustrated. The error processing circuitry 624 of FIG. 8 is similar to the error processing circuitry 124 of FIG. 4, as described herein. A difference is that the error processing circuitry 624 is configured to receive a pulse area signal 622 corresponding to the selected LED channel 610 (i.e., the LED channel 610 modulated at $f_p$) while error processing circuitry 124 is configure to receive pulse area signals 122-1, 122-2, . . . , 122-N corresponding to the plurality of LED channels 110-1, 110-2, . . . , 110-N. Accordingly, error processing circuitry 624 may be configured to receive and process the pulse areas corresponding to the LED channels 610 sequentially (i.e., one LED channel at a time).

Color coordinate converter circuitry 802 may be configured to convert the pulse area signal 622 from the detection circuitry 620 into a value that defines the light source in terms of standard photometric quantities, e.g., using LUT 804 as described herein. Comparator circuitry 806 may be configured to compare the output of color coordinate converter circuitry 802 to a user defined and/or programmed set of values 810 and to generate an error signal as an output. The values 810 may represent the target or desired overall brightness and/or color (temperature) of the LED strings. Storage 814 may be configured to sequentially receive the output (error signal) of the comparator circuitry 806 as each LED channel 610 is selected for detection and to store each error signal of the comparator circuitry 806 at a location defined by the identifier 630. The plurality of error signals stored in storage 814 may then be provided to error signal-to-duty cycle control signal converter circuitry 808 (which may generally correspond to circuitry 408 in FIG. 4). Circuitry 808 then uses LUT 812 to sequentially generate control signals 626-1, 626-2, . . . , 626-N for adjusting the brightness of the LED strings 610-1, 610-2, . . . , 610-N as described herein.

Figure 9:
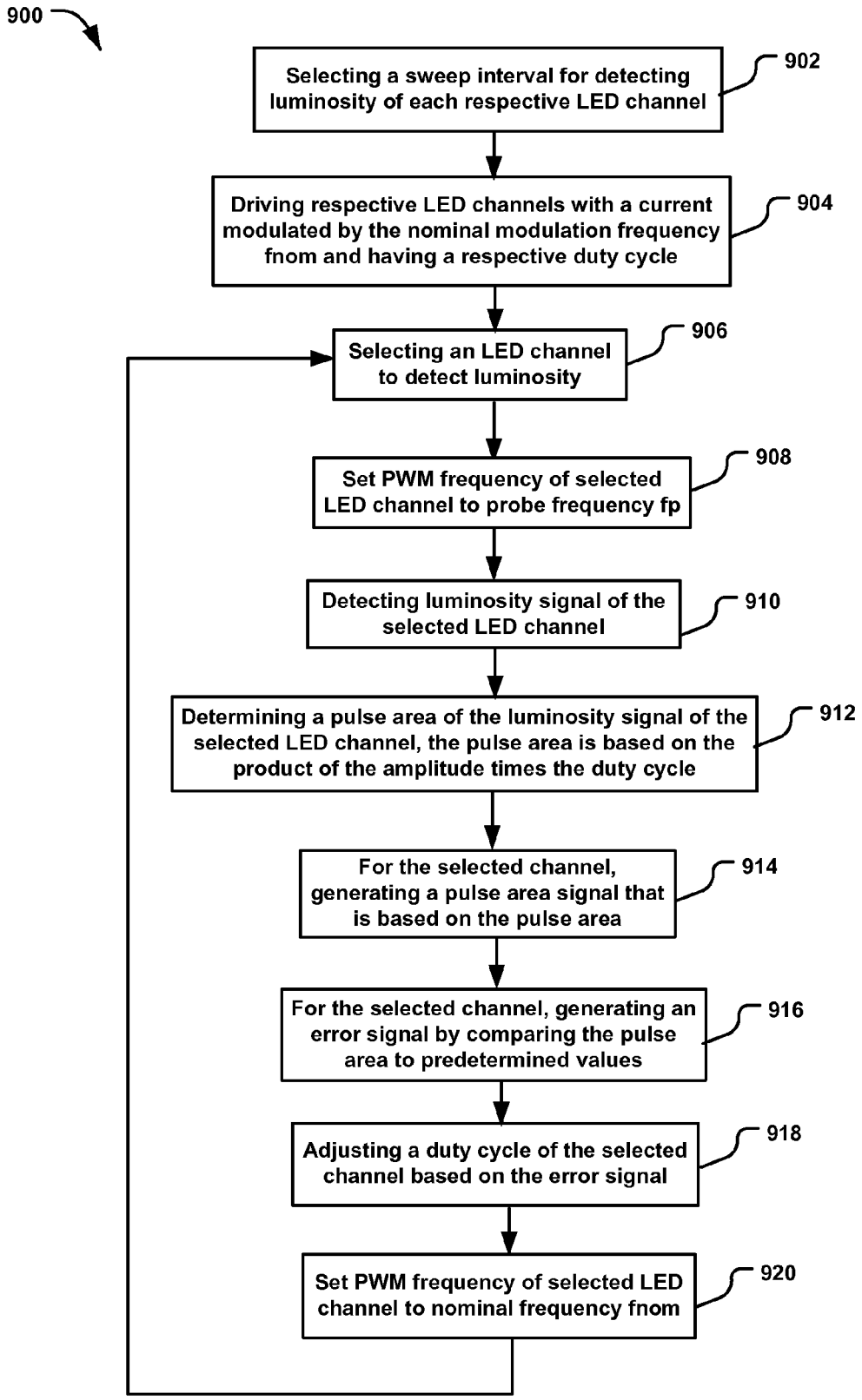
FIG. 9 is a block flow diagram of another exemplary method consistent with the present disclosure.

FIG. 9 is a block diagram 900 of another exemplary method consistent with the present disclosure. The method according to this embodiment may include selecting a sweep interval for detecting luminosity of each respective LED channel 902. The sweep interval corresponds to a time between detecting the brightness of the plurality of LED channels so that the duty cycle for each respective channel may be adjusted to compensate for any detected changes in brightness. Depending on the situation, the sweep interval may correspond to the duration of a detection sequence for the plurality of LED channels or the sweep interval may longer than this duration. The sweep interval may be predefined and/or may be adjustable.

Operation 904 may include driving each respective LED channel with a current modulated by the nominal modulation frequency $f_{nom}$ and having a respective duty cycle. If there is no selected channel, the plurality of LED channels may each be driven at the nominal modulation frequency, $f_{nom}$. Each respective LED may have a corresponding duty cycle. The corresponding duty cycle for each LED channel may have been adjusted in response to the detection of the luminosity of that LED channel, as described herein. Operation 906 may include selecting an LED channel for detecting the luminosity. The modulation frequency of the selected LED channel may be set to the probe frequency $f_p$ at operation 908. The luminosity signal of the selected LED channel may be detected at operation 910. The pulse area of the luminosity signal of the selected LED channel may be determined at operation 912. The pulse area is based on (e.g., proportional to) the product of the amplitude times the duty cycle. A pulse area signal that is based on the pulse area may be generated for the selected LED channel at operation 914. Operation 916 may include generating an error signal by comparing the pulse area for the selected LED channel to predetermined values. The duty cycle of the selected channel may be adjusted based on the error signal at operation 918. The modulation frequency of the selected LED channel may be set to the nominal frequency $f_{nom}$ at operation 920. Operations 906 through 920 may be repeated for each remaining respective LED channel of the plurality of LED channels. At an end of each sweep interval, operations 906 through 920 may be performed for each respective LED channel of the plurality of LED channels. In this embodiment, the method may enable continuous feedback control of the LED channels with error signals determined at an interval that depends on the sweep interval.

While FIG. 9 depicts exemplary operations according to one embodiment, it is to be understood that other embodiments of the present disclosure may include subcombinations of the operations depicted in FIG. 9 and/or additional operations described herein. Thus, claims presented herein may be directed to all or part of the components and/or operations depicted in one or more figures. In addition, there is no requirement that the operations depicted in FIG. 9, or described elsewhere herein, need to occur in the order presented, unless stated otherwise.

In addition, while the exemplary embodiments have described modulating the LED light strings using a PWM signal, one of ordinary skill in the art will recognize that the LED light strings may be modulated using other periodic waveforms including, but not limited to, sinusoidal waves, non-sinusoidal waves (e.g., but not limited to, sawtooth or triangle waves), and the like. For example, PWM circuitry 604 may be replaced by an oscillator such as, but not limited to, a harmonic oscillator and/or a relaxation oscillator.

Moreover, while the exemplary embodiments have described a photodetector 612 configured to generate a brightness signal 614 proportionate to the brightness of the output of the LED strings 610, it may be understood that that brightness signal 614 may be a nonlinear response. The controller 618 may be configured to correlate the nonlinear brightness signal 614 to a known response curve(s). Moreover, in many applications, the nonlinear brightness signal 614 may be considered linear for small deviations around the set points (see, for example, series expansion techniques such as, but not limited to, Taylor series functions or the like).

As used in any embodiment herein, "circuitry" may comprise, for example, singly or in any combination, hardwired circuitry, programmable circuitry, state machine circuitry, and/or firmware that stores instructions executed by programmable circuitry. In at least one embodiment, controller 618, photodetector 612, PWM circuitry 604 and/or driver circuitry 606 may collectively or individually comprise one or more integrated circuits. An "integrated circuit" may be a digital, analog or mixed-signal semiconductor device and/or microelectronic device, such as, for example, but not limited to, a semiconductor integrated circuit chip.

Embodiments of the methods described herein may be implemented using one or more processors and/or other programmable device. To that end, the operations described herein may be implemented on a tangible computer readable medium having instructions stored thereon that when executed by one or more processors perform the operations. Thus, for example, controller 118 may include a storage medium (not shown) to store instructions (in, for example, firmware or software) to perform the operations described herein. The storage medium may include any type of tangible medium, for example, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions.

Unless specifically stated otherwise, terms such as "operations," "processing," "computing," "calculating," "comparing," generating," "determining," or the like, may refer to the action and/or processes of a processing system, hardwire electronics, or an electronic computing device or apparatus, that manipulate and/or transform data represented as physical, such as electronic, quantities within, for example, registers and/or memories into other data similarly represented as physical quantities within the registers and/or memories.

Thus, in one embodiment, the present disclosure provides an LED controller including channel select circuitry, detection circuitry, and error processor circuitry. The channel select circuitry is configured to drive N−1 LED channels of a plurality of (N) LED channels at a nominal modulation frequency and to sequentially drive a selected one of the N LED channels at a probe modulation frequency. The detection circuitry is configured to receive a composite brightness signal corresponding to brightness signals from the N LED channels. The detection circuitry is further configured to filter the composite bright signal and generate a selected brightness signal corresponding to a brightness of the selected LED channel at the probe modulation frequency. The error processor circuitry is configured to compare the selected brightness signal to user defined and/or preset photometric quantities and generate a control signal for adjusting the brightness of the selected LED channel.

In another embodiment, the present disclosure provides a method for controlling a plurality of (N) LED channels. The method includes: driving N−1 LED channels of the N LED channels at a nominal modulation frequency; sequentially driving a selected one of the N LED channels at a probe modulation frequency; receiving a composite LED brightness signal corresponding to brightness signals from the N LED channels; filtering the composite bright signal and generating a selected brightness signal corresponding to a brightness of the selected LED channel at the probe modulation frequency; and generating a control signal for adjusting the brightness of the selected LED channel based on a comparison of the selected brightness signal to user defined and/or preset photometric quantities.

In another embodiment, the present disclosure provides an apparatus that includes at least one storage medium having stored thereon, individually or in combination, instructions. The instructions, when executed by at least one processor, result in the following operations: driving N−1 LED channels of a plurality of (N) LED channels at a nominal modulation frequency; sequentially driving a selected one of the N LED channels at a probe modulation frequency; receiving a composite LED brightness signal corresponding to brightness signals from the N LED channels; filtering the composite bright signal and generating a selected brightness signal corresponding to a brightness of the selected LED channel at the probe modulation frequency; and generating a control signal for adjusting the brightness of the selected LED channel based on a comparison of the selected brightness signal to user defined and/or preset photometric quantities.

In still another embodiment, the present disclosure provides a system including a plurality of (N) light emitting diode (LED) channels, a photodetector circuit, and a LED controller. Each of the LED channels including a LED string having at least one LED, modulation circuitry configured to generate a modulation signal at either a probe modulation frequency or a nominal modulation frequency, and driver circuitry configured to provide current to the N LED string. The photodetector circuit is configured to generate a composite LED brightness signal corresponding to brightness signals from the N LED channels. The LED controller includes channel select circuitry, detection circuitry, and error processor circuitry. The channel select circuitry is configured to drive N−1 LED channels at the nominal modulation frequency and to sequentially drive a selected one of the N LED channels at the probe modulation frequency. The detection circuitry is configured to filter the composite bright signal and generate a selected brightness signal corresponding to a brightness of the selected LED channel at the probe modulation frequency. The error processor circuitry is configured to compare the selected brightness signal to user defined and/or preset photometric quantities and generate a control signal for adjusting the brightness of the selected LED channel.

Thus, the embodiments described herein may be configured to compensate, via negative feedback, for unintended changes in brightness in one or more LED channels by changing the duty cycle for one or more LED channels in proportion to the error signal and thereby reducing the total error signal towards zero. Advantageously, using two modulation frequencies (nominal and probe) may result in comparatively simpler circuitry. Using the two modulation frequencies may further result in a reduced susceptibility to interference and/or beating between multiple frequencies.

Modifications and substitutions by one of ordinary skill in the art are considered to be within the scope of the present disclosure, which is not to be limited except by the following claims.

What is claimed is:

1. A light emitting diode (LED) controller, comprising:

channel select circuitry configured to drive N−1 LED channels of a plurality of (N) LED channels at a nominal modulation frequency and to selectively drive a selected one of the N LED channels at a probe modulation frequency;

detection circuitry configured to receive a composite brightness signal corresponding to brightness signals from the N LED channels, the detection circuitry further configured to filter the composite bright signal and generate a selected brightness signal corresponding to a brightness of the selected LED channel at the probe modulation frequency; and error processor circuitry configured to compare the selected brightness signal to user defined and/or preset photometric quantities and generate a control signal for adjusting the brightness of the selected LED channel.

2. The LED controller of claim 1, wherein the control signal is configured to control a duty cycle of the selected LED channel.

3. The LED controller of claim 1, wherein the control signal is configured to control an amplitude of a drive current provided to the selected LED channel.

4. The LED controller of claim 1, wherein for each sequentially selected LED channel, the detection circuitry is further configured to determine a pulse area signal based on the product of an amplitude and a duty cycle of the selected brightness signal.

5. The LED controller of claim 1, wherein the probe frequency is greater than the nominal modulation frequency.

6. The LED controller of claim 1, further comprising a broadband photodetector circuit configured to output the composite brightness signal.

7. A method for controlling a plurality of (N) LED channels, the method comprising:

driving N−1 LED channels of a plurality of (N) LED channels at a nominal modulation frequency;

selectively driving a selected one of the N LED channels at a probe modulation frequency;

receiving a composite LED brightness signal corresponding to brightness signals from the N LED channels;

filtering the composite bright signal and generating a selected brightness signal corresponding to a brightness of the selected LED channel at the probe modulation frequency; and generating a control signal to adjust the brightness of the selected LED channel based on a comparison of the selected brightness signal to user defined and/or preset photometric quantities.

8. The method of claim 7, further comprising adjusting a duty cycle of the selected LED channel based on the control signal.

9. The method of claim 7, further comprising adjusting an amplitude of a drive current provided to the selected LED channel based on the control signal.

10. The method of claim 7, further comprising determining, for each sequentially selected LED channel, a pulse area signal based on the product of an amplitude and a duty cycle of the selected brightness signal.

11. The method of claim 7, further comprising generating the composite brightness signal using a broadband photodetector circuit.

12. The method of claim 7, further comprising selecting a sweep interval for sequentially selecting which of said N LED channels is driven at the probe modulation frequency.

13. An apparatus, comprising one or more storage mediums having stored thereon, individually or in combination, instructions that when executed by one or more processors result in the following operations, comprising:

driving N−1 LED channels of a plurality of (N) LED channels at a nominal modulation frequency;

selectively driving a selected one of the N LED channels at a probe modulation frequency;

receiving a composite LED brightness signal corresponding to brightness signals from the N LED channels;

filtering the composite bright signal and generating a selected brightness signal corresponding to a brightness of the selected LED channel at the probe modulation frequency; and generating a control signal to adjust the brightness of the selected LED channel based on a comparison of the selected brightness signal to user defined and/or preset photometric quantities.

14. The apparatus of claim 13, wherein the instructions that when executed by one or more of the processors result in the following additional operations, comprising selecting a sweep interval for sequentially selecting which of said N LED channels is driven at the probe modulation frequency.

15. The apparatus of claim 13, wherein the instructions that when executed by one or more of the processors result in the following additional operations, comprising adjusting a duty cycle of the selected LED channel based on the control signal.

16. The apparatus of claim 13, wherein the instructions that when executed by one or more of the processors result in the following additional operations, comprising adjusting an amplitude of a drive current provided to the selected LED channel based on the control signal.

17. The apparatus of claim 13, wherein the instructions that when executed by one or more of the processors result in the following additional operations, comprising determining, for each sequentially selected LED channel, a pulse area signal based on the product of an amplitude and a duty cycle of the selected brightness signal.

18. The apparatus of claim 13, wherein the instructions that when executed by one or more of the processors result in the following additional operations, comprising generating the composite brightness signal using a broadband photodetector circuit.

19. A system, comprising:

a plurality of (N) light emitting diode (LED) channels, each LED channel comprising:

a LED string including at least one LED;

modulation circuitry configured to generate a modulation signal at either a probe modulation frequency or a nominal modulation frequency; and driver circuitry configured to provide current to the N LED string;

a photodetector circuit configured to generate a composite LED brightness signal corresponding to brightness signals from the N LED channels; and an LED controller comprising:

channel select circuitry configured to drive N−1 LED channels at the nominal modulation frequency and to selectively drive a selected one of the N LED channels at the probe modulation frequency;

detection circuitry configured to filter the composite bright signal and generate a selected brightness signal corresponding to a brightness of the selected LED channel at the probe modulation frequency; and error processor circuitry configured to compare the selected brightness signal to user defined and/or preset photometric quantities and generate a control signal for adjusting the brightness of the selected LED channel.

20. The system of claim 19, wherein the LED controller is further configured, for each sequentially selected LED channel, to determine a pulse area signal based on the product of an amplitude and a duty cycle of the selected brightness signal; and wherein the control signal is configured to adjust the current provided by the driver circuitry to the selected LED channel to adjust the brightness of the selected LED channel.

* * * * *